United States Patent [19]

Jenkins et al.

[11] Patent Number: 5,056,245

[45] Date of Patent: Oct. 15, 1991

[54] SNOW REMOVER

[76] Inventors: Stephen L. Jenkins; Stephen L. Jenkins, Jr., both of 7 Stillforest, Houston, Tex. 77024

[21] Appl. No.: 544,948

[22] Filed: Jun. 28, 1990

[51] Int. Cl.[5] ..... E01H 5/02

[52] U.S. Cl. ..... 37/265; 37/130; 37/284; 280/8; 280/767; D8/10; D32/15

[58] Field of Search ..... 37/265, 284, 285, 130; 294/54.5; 280/8, 47.24, 47.30, 47.31, 47.32, 767; D32/15, 16, 46; D8/10, 14, 16

[56] References Cited

U.S. PATENT DOCUMENTS

| | | | |
|---|---|---|---|
| 1,813,159 | 7/1931 | Gunderson | 37/130 |
| 2,219,905 | 10/1940 | Prickman | 280/8 X |
| 2,433,246 | 12/1947 | Stelzer | 280/8 |
| 3,106,303 | 10/1963 | Finocchiaro | 37/130 |
| 4,245,411 | 1/1981 | McMath | 37/285 X |
| 4,516,799 | 5/1985 | O'Donnell | 294/54.5 |
| 4,607,872 | 8/1986 | Herner | 37/285 X |

FOREIGN PATENT DOCUMENTS

| | | | |
|---|---|---|---|
| 1123354 | 1/1959 | Fed. Rep. of Germany | 37/130 |

*Primary Examiner*—David H. Corbin
*Assistant Examiner*—Arlen L. Olsen
*Attorney, Agent, or Firm*—James A. Bargfrede

[57] ABSTRACT

An article of manufacture is provided for use primarily in removal of snow from driveways, sidewalks, decks and other locations where snow accumulates and needs to be removed. Such article of manufacture also may be used as a dolly, sled, or a trailer-like device for pulling by a vehicle or snowmobile.

5 Claims, 1 Drawing Sheet

FIG. 1
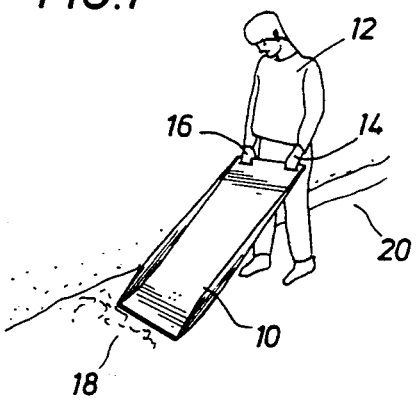
FIG. 4
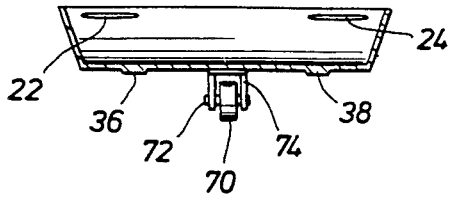
FIG. 6
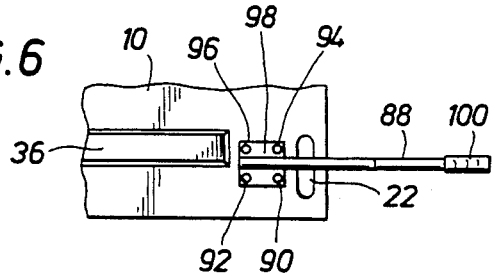
FIG. 2
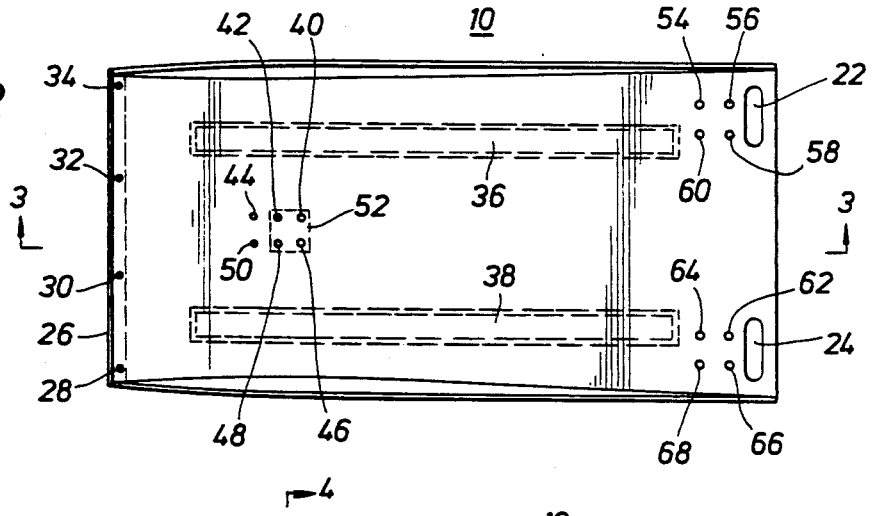
FIG. 3
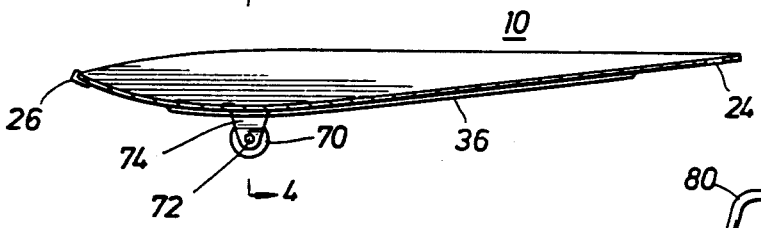
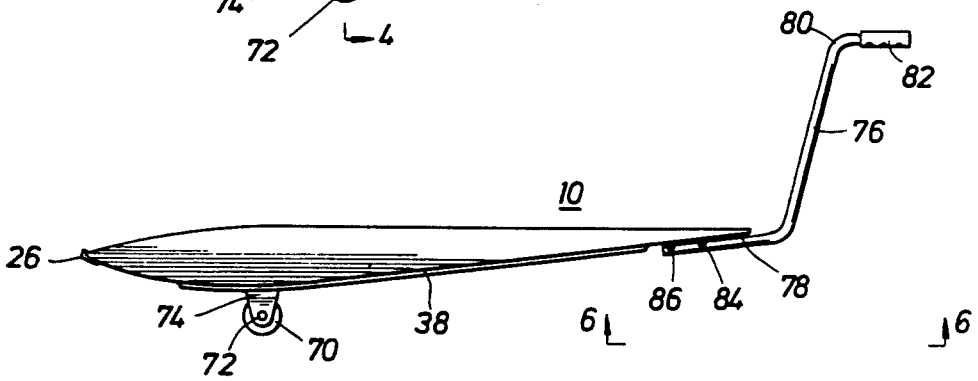
FIG. 5

SNOW REMOVER

CROSS-REFERENCE TO RELATED APPLICATION

The present application is an improvement to the co-pending design patent application filed Apr. 23, 1990 having Ser. No. 07/513,158 entitled "Snow Remover".

BACKGROUND OF THE INVENTION

1. Field of the Invention

The present invention relates to an item of hardware used principally for snow removal from sidewalks and driveways.

2. Description of Related Art

U.S. Pat. No. 4,916,837 issued Apr. 17, 1990 to Olmr et al is directed to a "Single Stage Snowthrower" and indicates the present lack of a known, simple snow remover inasmuch as the disclosure of such Patent provides a complex, expensive, and ineffective snow throwing device.

Summary of the Invention

An article of manufacture adapted for use as a snow remover is provided and is characterized by a simple, light-weight, elongated structure having a plurality openings at one end and a metal attachment at the opposite end to create proper friction for scraping most outdoor surfaces and for providing durability when scraped across rough surfaces for a long period of time. An important feature of the invention is a single roller or wheel which is positioned near the end of the snow remover having the metal attachment thereby allowing the snow remover to be pushed with minimal effort by an individual person. Also, openings may be provided on the sides if desired. The length of the snow remover and the positioning of the wheel allow the person pushing the snow remover to grasp such snow remover near the waist to allow maximum, yet comfortable, force to be applied to such snow remover. A plurality of handles are positioned near the end of the snow remover to allow adaptability of the snow remover for use as a dolly to transport various items such as pot plants or dirt around a lawn, for example. Also, the article of manufacture of the present invention may be attached to a vehicle such as a snowmobile and used as a trailer. The bottom of the article of manufacture has a plurality of elongated protrusions to add strength on the ground when the article of manufacture is used as a snow remover and to act as keels when used as a sled.

BRIEF DESCRIPTION OF THE DRAWING

FIG. 1 is a perspective view of an individual using the device of the present invention;

FIG. 2 is a top, plan view of the device of the present invention;

FIG. 3 is a side, elevational, partial sectional view taken along line 3—3 of FIG. 2;

FIG. 4 is an end, elevational, partial sectional view taken along line 4—4 of FIG. 3;

FIG. 5 is a side, elevational view of the device of the present invention showing handles attached; and FIG. 6 is a bottom, elevational view of part of the device of the present invention taken along line 6—6 of FIG. 5.

DESCRIPTION OF THE PREFERRED EMBODIMENTS

FIG. 1 is a perspective view of the device 10 of the present invention in use by an individual 12 having hands 14 and 16 positioned in openings of the device 10 for stabilization and control of the directional movement of the device 10 when being used to remove snow 18 from a sidewalk 20. It will be appreciated that the device of the present invention may be utilized for removal of snow at any location where the snow has accumulated and needs to be removed. The device of the present invention is contoured and shaped so that an individual utilizing such device needs only to apply minimal effort in pushing the device of the present invention because, in most instances, the device is approximately waist-high for the individual using such device.

The device of the present invention uses a scraping and scooping motion which lifts the snow at an angle to allow for accumulation and packing of the snow. The snow is discarded with a lateral motion by lifting either one of the handles and depositing the snow to the side of the device. As will be explained in detail subsequently, the configuration of the device of the present invention is such that the bottom edge reaches the ground and the top edge, as pointed out previously, is approximately waist-high, thereby allowing an average-sized individual to lean into the device to create a forward motion while using the handles of the device to balance and guide or direct such device. The forward motion is generated from the waist and arms thereby putting very little pressure on the lower back of the individual who is utilizing such device. As will be explained in detail subsequently, an optional wheel assembly allows easier forward motion and carries some of the weight of the load on the device. The wheel can be removed for lighter jobs.

FIG. 2 is a top, plan view of the article of manufacture or device 10 of the present invention. Such device may be manufactured from a durable, weather-resistant, rigid, plastic material which will withstand varying climate conditions or from steel and wood. Essentially, such device is designed so that the bottom edge and the wheel are in contact with the ground thereby allowing a rolling and scraping function.

At one end of the device are a plurality of openings such as opening 22 and opening 24. These openings are elongated to accommodate the hands of an individual who is using the device.

At the end opposite from the openings is a metal strip 26 which extends along the entire edge of the device and is attached, for example with a plurality of fasteners such as bolts 28, 30, 32 and 34. It will be appreciated that the device of the present invention may be used for leveling dirt as well as for snow removal.

The metal strip 26 has two main purposes. One purpose is to create the proper friction for scraping most outdoor surfaces such as concrete, wood, asphalt, or gravel. The second purpose is to provide durability when the device is scraped across rough surfaces for long durations of time. A plurality of elongated raised surfaces such as surface 36 and surface 38 extend along the longitudinal axis of the device for approximately three-fourths of the total length of the device.

A plurality of openings such as opening or hole 40, 42, 44, 46, 48 and 50 allow a wheel having a plate 52 to be fastened to the lower portion of the device with a plurality of bolts, for example, and to allow for adjustment for the height of the operator.

A plurality of holes such as hole 54, 56, 58 and 60 are positioned near opening 22 to allow a handle to be attached to the device 10 in a manner to be explained subsequently.

Near opening 24 are a plurality of holes such as hole 62, 64, 66 and 68. These holes also allow a handle to be attached near opening 24 as will be explained subsequently.

FIG. 3 is a side, elevational, partial sectional view of the device 10 of the present invention showing wheel 70 positioned on axle 72 to support member 74 which is attached to the lower portion of the device 10 with a plurality of bolts positioned in the holes mentioned in connection with FIG. 2.

Metal strip 26 is shown positioned at the end of the device 26 opposite from openings 22 and 24. Elongated, raised surface 36 is positioned along the lower portion of the device which has a suitable curvature to allow optimum use of the wheel arrangement at the lowermost portion of the curved bottom surface.

FIG. 4 is an end, elevational, partial sectional view of the device taken along line 4—4 of FIG. 3. The elongated, raised surface 36 and the elongated, raised surface 38 are shown positioned on either side of the wheel 70 positioned on axle 72 in support member 74. Opening 22 and opening 24 are positioned near the uppermost surface of the device to allow the device to achieve optimum results as pointed out previously.

FIG. 5 is a side, elevational view of the device 10 showing handle 76 attached to such device. Handle 76 may be comprised of any suitable material with a bent lower portion 78 attached to device 10 near each of the openings 22 and 24. Upper portion 80 of the handle 76 may have a grip 82 attached to allow hands of an individual to better hold the handle 76.

Lower portion 78 may be attached to the device 10 with a plurality of bolts such as bolt 84 and 86.

When handles such as handle 76 are attached to the device, such device can be used as a light garden dolly or wheelbarrow. Small loads such as firewood, plants, dirt and other objects may be moved around a home or business by utilizing the device of the present invention. The wheel carries the load and because there is only one wheel, the device is highly maneuverable and the device also may be easily stored by hanging the device on a wall having nails, for example, which may fit inside of the openings 22 and 24.

The device of the present invention also can be used as a sled or toboggan since it is large enough for two adults or two children to slide down a hill.

FIG. 6 is a bottom, elevational view taken along line 6—6 of FIG. 5 and shows handle 88 attached to device 10 with a plurality of bolts such as bolts 90, 92, 94 and 96. These bolts extend into plate 98 having handle 88 attached thereto. Grip 100 is positioned on handle 88 as explained previously in connection with FIG. 5. Elongated, raised surface 36 is shown in FIG. 6 extending to the area of plate 98. Opening 22 is shown in FIG. 6 and handle 88 is positioned substantially in the middle of opening 22 to allow optimum handling of the device.

Thus, it will be appreciated that the present invention provides a device capable of removing snow in an efficient, economical, simple, and safe manner not known and used prior to the present invention. The device may be fitted with a wheel assembly and with optional handles to allow versatility of use of the device as a dolly or wheelbarrow. The device of the present invention also may be attached to a vehicle for use as a trailer. The device of the present invention is relatively easy to manufacture and maintain and, when used properly, may be utilized for a long period of time.

Although preferred embodiments of the invention have been shown and described, it will be appreciated by those skilled in the art to which the present invention pertains that modifications and improvements may be made without departing from the spirit of the invention defined by the claims.

We claim:

1. An article of manufacture adapted for snow removal including in combination an elongated, unitary scoop having a curved lower portion, a plurality of holes extending through the center of said scoop at said curved lower portion, said scoop consisting of a single wheel attached to the bottom of said scoop using some of said plurality of holes, first and second elongated openings on one end of said scoop, first and second sides extending along the length of said scoop, and first and second elongated protrusions extending longitudinally along the bottom of said scoop, and a metal strip attached to the edge of said scoop at the end opposite the end having said first and second elongated openings.

2. An article of manufacture adapted for snow removal defined by claim 1 and further including extended handle means positioned over each of said first and second elongated openings.

3. An article of manufacture adapted for snow removal defined by claim 1 wherein said wheel allows said scoop to be pushed at substantially waist level of an individual.

4. An article of manufacture including in combination an elongated scoop having a curved surface on the bottom, first and second sides on said scoop, first and second parallel protrusions extending along the longitudinal axis of said scoop, first and second elongated openings at one end of said scoop, a plurality of holes in said scoop near each of said first and second elongated openings, a plurality of openings on said curved surface between said first and second parallel protrusions, a plurality of apertures on the end of said body opposite the end having said first and second elongated openings, a metal strip attached to said body with first fastening means positioned in said plurality of apertures, and wherein said scoop consists of a single wheel attached to the bottom of said scoop by second fastening means positioned in some of said plurality of openings on said curved surface.

5. An article of manufacture defined by claim 4 and further including first and second extended handle members attached to said scoop with third and fourth fastening means in said plurality of holes near each of said first and second elongated openings.

* * * * *